US005931313A

United States Patent [19]

Kane

[11] Patent Number: 5,931,313

[45] Date of Patent: Aug. 3, 1999

[54] STACKABLE AND COLLAPSIBLE STORAGE HOLDER FOR FLEXIBLE BAGS

[76] Inventor: Judith Kane, 217 Bowsprit La., Foster City, Calif. 94404

[21] Appl. No.: 08/808,194

[22] Filed: Feb. 28, 1997

[51] Int. Cl.[6] ..... B42F 17/00

[52] U.S. Cl. ..... 211/12; 211/126.9; 211/194; 206/511; 220/495.1

[58] Field of Search ..... 211/12, 181.1, 211/126.9, 133.5, 194, 10; 220/495.1, 495.01, 485; 206/511, 512

[56] References Cited

U.S. PATENT DOCUMENTS

| | | | |
|---|---|---|---|
| D. 277,707 | 2/1985 | Rico | D34/6 |
| 2,503,811 | 4/1950 | Emigholz et al. . | |
| 2,600,439 | 6/1952 | Sloane | 220/495.1 X |
| 3,072,281 | 1/1963 | Reilly | 206/512 X |
| 3,314,549 | 4/1967 | Goldreich et al. | 206/511 X |
| 3,349,939 | 10/1967 | Averill | 206/511 X |
| 3,410,328 | 11/1968 | Sasai | 150/49 |
| 4,165,003 | 8/1979 | Drader | 206/512 X |
| 4,176,747 | 12/1979 | Aho | 206/509 |
| 4,623,111 | 11/1986 | Prader | 220/495.01 X |
| 4,651,791 | 3/1987 | Evenson | 150/50 |
| 4,919,267 | 4/1990 | Stoll | 206/507 |
| 5,014,944 | 5/1991 | Malik et al. | 248/99 |
| 5,071,008 | 12/1991 | Hradisky | 206/507 |
| 5,119,958 | 6/1992 | Gabert et al. | 220/404 |
| 5,141,110 | 8/1992 | Trischan et al. | 209/524 |
| 5,183,174 | 2/1993 | Quintero | 220/404 |
| 5,186,330 | 2/1993 | McClure | 206/508 |
| 5,193,683 | 3/1993 | Key | 206/503 |
| 5,209,693 | 5/1993 | Lyman | 446/104 |
| 5,275,289 | 1/1994 | Blatt | 206/513 |
| 5,316,152 | 5/1994 | Ross | 209/630 |
| 5,393,566 | 2/1995 | Propst | 427/348 |
| 5,711,499 | 1/1998 | Sectish | 220/495.1 X |

*Primary Examiner*—Blair M. Johnson
*Attorney, Agent, or Firm*—David C. West; Kevin H. Fortin, Esq.

[57] ABSTRACT

A stack and sack waste container for holding, sorting and disposing of recyclable refuse. The container comprises a plurality of substantially similar frames, where each frame includes a locking aperture, a receiving aperture, a large aperture, an upper concave lead-in or locking notch, an upper convex lead-in or receiving notch, a lower convex lead-in or locking notch and a lower concave lead-in or receiving notch. The frames also have two opposing handles. The holder is formed by the interconnection of said frames, and where the frames pieces are interconnected by the locking means being connected to the receiving means of a adjoining frames. The structure of the holder allows for a plurality of such containers to be stacked in a vertical fashion.

4 Claims, 6 Drawing Sheets

STACKABLE AND COLLAPSIBLE STORAGE HOLDER FOR FLEXIBLE BAGS

FIELD OF THE INVENTION

The present invention relates generally to trash containers and, more specifically, to a holder which provides for a means for stacking and nesting a top holder onto a bottom holder while providing handles for holding bags where recyclable refuse and other items can be organized for proper disposal. The holder is intended particularly for the holding, sorting and disposing of recyclable refuse such as plastic, paper, glass and aluminum refuse as well as similar products from the home, office or apartment.

The holders are capable of holding the handles of paper and plastic grocery bags to facilitate the holding, sorting and disposing of the refuse. Additionally, the holders provide for larger apertures on every side of the holder so that the refuse can be easily deposited into the bags held by the holders and so that the sorted refuse can be conveniently accessed for proper disposal.

BACKGROUND OF THE INVENTION

Containers for holding and storing waste and other materials have been known in the art for a long time. A typical container will have a storage space for holding the waste, as well as an opening leading to the storage space which allows the person to deposit the waste in the storage space.

Many communities presently have recycling programs wherein the residents of the community collect and separate items such as paper, plastic, glass and aluminum that they use in their home, office or apartment. As these items need to be separated, people desire to store them in separate waste containers. The requirement of having multiple waste containers in a room, however, creates a cost and space burden for the collector of the items. Thus, there is a need for efficient and economical stackable waste containers that allow a person to separate and store items such as recyclable products.

Plastic stackable one-piece waste containers have been in existence for a long time. These containers, however, suffer from major disadvantages. One of these disadvantages is that the structure of the containers makes them extremely inconvenient to use in a practical way.

For example, when the containers are stacked on top of each other, it is very difficult and often times quite impossible to access and remove the items stored in a container that is beneath another container because the upper containers block or impede convenient access to the lower containers. In order to unload the lower containers, it is frequently necessary to unstack the containers. This procedure is, of course, quite inconvenient and defeats a major benefit of stacked containers.

Thus, traditional containers for waste disposal, as well as any other container of this type, are not suitable for the sorting or disposing of recyclable refuse due to the fact that the items stored in such containers cannot be taken out easily through the side apertures when the containers are stacked up. This is particularly true when the containers are located in a small area in a residential kitchen so that the side apertures of the containers may face the take out orifices of the kitchen area.

The removal of refuse, therefore, especially from the lowest stacked up container, is difficult since the service opening frequently does not reach to the bottom of the container. In some prior art cases, the containers have apertures that are made so high that the refuse could be removed more easily. However, these containers resulted in superfluous empty spaces remaining in the upper parts of the containers. This, in turn, meant that the containers would not be economical in regards to the utilization of the space and the cost to manufacture and use such containers.

Additionally, proper recycling of the earth's limited resources is an increasing concern and a problem that must be addressed. The use of plastics in our society is endemic. While plastic containers can be convenient to consumers and inexpensive to manufacturers, after they are used, they must be disposed of properly. In many instances, plastic containers were dumped into land fills or otherwise disposed of in an environmentally unfriendly manner.

Some communities have now requested that their residents collect and store the used plastic containers for recycling. The recycling of these materials will only be effective, however, if there is a market for recycled plastics. One problem with recycled plastics is that the market is not as developed as it is for glass and aluminum. Thus, it is critical to find new uses for recycled plastics. The present invention provides such a use.

Furthermore, many grocery stores and supermarkets commonly supply consumers with paper, plastic or polyethylene bags for holding groceries. Such bags are also used by consumers to provide a disposable receptacle for other items, both edible and inedible. These paper, plastic and polyethylene bags frequently have handles that make it easier for the consumer to transport the groceries.

The bags are usually received free from the vendor or merchant as a convenient means of carrying the customers' purchases from the store generally to the purchasers' car, and then to the purchasers' home. After removing the purchases from these bags, however, the customer usually has a problem as the bags present the issue of proper disposal. Thus, there is also a need for a container that is able to use these bags in a practical and efficient manner so that the bags are not merely thrown away. Once again, the present invention satisfies this need.

There are several types of conventional trash containers proposed in the prior art. These containers, however, suffer from many disadvantages and do not provide the novel improvements of the present invention as disclosed herein.

For example, U.S. Pat. No. 3,410,328 entitled "*Delivery Containerfor Perishable Foods*" was issued to Sashi on Nov. 12, 1968. This patent involves upper and lower continuous, four sided members held together by four pairs of struts arranged in an "X" pattern. The ends of the strut members are mounted in slots in a manner permitting the upper and lower continuous members to be pulled apart when the device is to be used, or pushed together at the time of storage.

The Sashi configuration, however, necessarily utilizes a number of carefully formed components that could not be produced inexpensively, nor fitted together except by the employment of a sizable amount of hand labor. Thus, the container disclosed in Sashi is expensive to manufacture, expensive to purchase and difficult and inefficient to assemble.

Another prior art container is that disclosed in U.S. Pat. No. 5,119,958 entitled "*Sort and Cycle Bin*" and issued to Gabert et al. on Jun. 9, 1992. This patent concerns a bin that involves a plurality of horizontally oriented and vertically spaced apart components with a plurality of removable containers within the compartments. Each compartment contains hooks and loops for the containers. The compartments are arranged in subjective patterns for sorting materials.

The bin disclosed by Gabert et al. is not very practical, however, as it requires a large amount of floor space. Thus, unlike the present invention, the bin is costly to manufacture and buy, is not environmentally friendly and is not substantially maintenance free. Additionally, the bin disclosed by Gabert et al. is not capable of holding plastic handled bags in an open condition that cooperates with open vertical surroundings.

Another prior art container is disclosed in U.S. Pat. No. 5,183,174 entitled "*Specialized Ear-Handled Holder-Container*" and issued to Quintero on Feb. 2, 1993. This patent involves a specialized piggy back container and second holder container with ear handles to receive one or more trash bags with bag handles. The bag handles are looped over the ear handles. However, the device disclosed by Quintero necessitates the use of two separate non-stackable containers. Furthermore, the container represents a device that uses excessive materials which consume valuable space in a home, office or apartment as well as lead to excessive costs to manufacture and buy.

A stackable container is also disclosed in U.S. Pat. No. 4,176,747 entitled "*Stackable Crates*" and issued to Aho on Dec. 4, 1979. This patent involves a container that is intended to be used to transport and store milk. The container has a main and bottom portion. The main portion has front, rear and side walls that are open to the bottom. The bottom portion is of the grating type, detachable and pivotable, allowing it to be turned upwards and left in the upturned position so that the goods can be taken out through the tops of the empty upper crates when several of the crates are stacked up. Apertures on the front and/or rear walls of the crates, when stacked up, make a combined, almost full height aperture which also allows the goods to be taken out sideways from the stacked crates.

The configuration of the container disclosed in Aho suffers from the absents of handles, ears, or a pair of tabs that are capable of holding paper or plastic bags with handles in the open position. Thus, the container in Aho lacks any convenient means of storing and removing loose material, such as recyclable waste. Additionally, the construction and design of this container results in excess bulk, thereby increasing the cost and inefficiencies of the container.

The objective of the present invention is to provide for a stackable waste holder that eliminates the many drawbacks of the prior art containers described above. A further objective of the present invention is to create a stackable waste holder that allows for the sorting, holding and disposing of recyclable refuse, such as paper, glass, plastic and aluminum in a convenient fashion.

To this end, the present invention permits the sorting, holding and disposing of recyclable refuse in plastic bags with handles that are secured to the holders. The bags can be taken out easily from the holders while the holders are stacked up and, if desired, adjacent to regular trash containers, so that the holder's orifices, and thus, the bags containing the refuse, are accessible to the consumer, whether they are in a kitchen of a house or apartment, or in a place of business.

The present invention evolved as a means of overcoming the disadvantages and expense of the prior art containers described above. The present device is particularly able to be produced very economically, efficiently and in a variety of materials and colors, depending upon the particular desires of the consumer. Furthermore, the invention is environmentally friendly. The holder provides a use for plastic bags that otherwise would be thrown away. Additionally, the frames of the holder can be manufactured out of recycled plastic, thereby providing a market from such materials.

SUMMARY OF THE INVENTION

The present invention relates to a stackable and collapsible storage container for sorting, holding and disposing of a variety of material, including recyclable items, such as paper, plastic, glass and aluminum. This storage container is created through the use of four substantially similar manufactured frames that are joined in such a way as to form a generally rectangular holder. The holder has handles for the attachment of plastic or paper bags with handles.

Each of the holders are capable of being vertically nested with other holders to form a stacked container with multiple holders. This permits that sorting, holding and disposing of different types of recyclable items.

The cornerstone of the holder is the uniquely-designed frame. The frame can be formed of a variety of materials, but preferably is made of recycled plastic, thereby contributing to the environmentally friendly aspects of the invention. The frame includes notches which are used to join the individual frames to one another. In addition, each of the frames has a handle available for the convenient attachment of handled bags. The major portions of the frames are open, producing apertures that allows for access to the interior of the holder and to the bags contained therein.

Thus, according to major features of the invention, plastic interconnecting stackable holders are provided for the sorting, holding and discarding of recyclable goods. The holders comprise main top and bottom portions, the former with front, rear and side walls that are open to the top, and bottom portions. The top and bottom portions of the front, rear and side walls are notched on each corner allowing each frame to be interconnected into a formal holder.

According to another feature of the invention, the stackable recyclable holders are provided for use with plastic bags with handles for discarding and sorting recyclable goods. The frames allow goods to be taken out through the front, rear, sides, top and bottom of the full upper or lower holders when several of them are stacked up. Apertures on the front, side or rear walls of the holder, when stacked up, make a combined, almost full length aperture which also allows the goods to be taken out from the top, bottom or side of the stacked holders.

The holder is both stackable and collapsible. This holder not only can be manufactured in an efficient fashion, but when shipped as four individual frames, has a very small shipping volume. This construction also allows the holder to be collapsible for temporary storage by the user.

Thus, the present invention accomplishes numerous objectives. A primary objective of the present invention is to provide a stackable holder that will overcome the shortcomings of the prior art devices.

Another objective of the invention is to provide a stackable holder that includes handles for holding a plurality of bags with handles so as to organize recyclable items in the home, office or apartment.

An addition objective of the invention is to provide a stackable holder as a means of stacking one holder on top of another holder forming almost a full height aperture which allows recyclable trash to be removed easily from the top, bottom or sides of the stacked holders.

A further objective of the invention is to provide a holder that is simple and easy to use.

A further objective of the invention is to provide a holder that is economical in cost to manufacture.

A further objective of the invention is to provide a holder that is made from 98% less material than the traditional waste container.

A further objective of the invention is to provide a holder which is rigid and can be produced in various bright colors.

Further objectives of the invention will appear as the description proceeds.

To the accomplishment of the above and related objectives, this invention may be embodied in the form illustrated in the accompanying drawings. Attention being drawn to the fact, however, that the drawings are illustrative only in that changes may be made in specific construction illustrated and described within the scope of the appended claims.

DETAILED DESCRIPTION OF THE INVENTION

Figure 1:
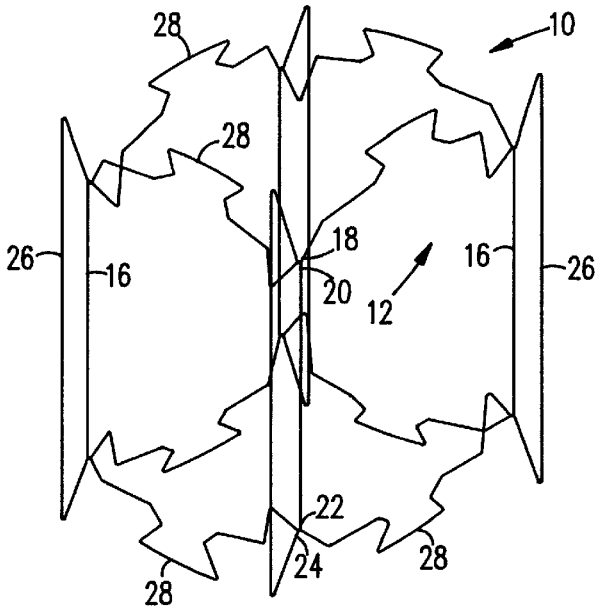
FIG. 1 is a perspective view of the holder according to the invention.
Figure 2:
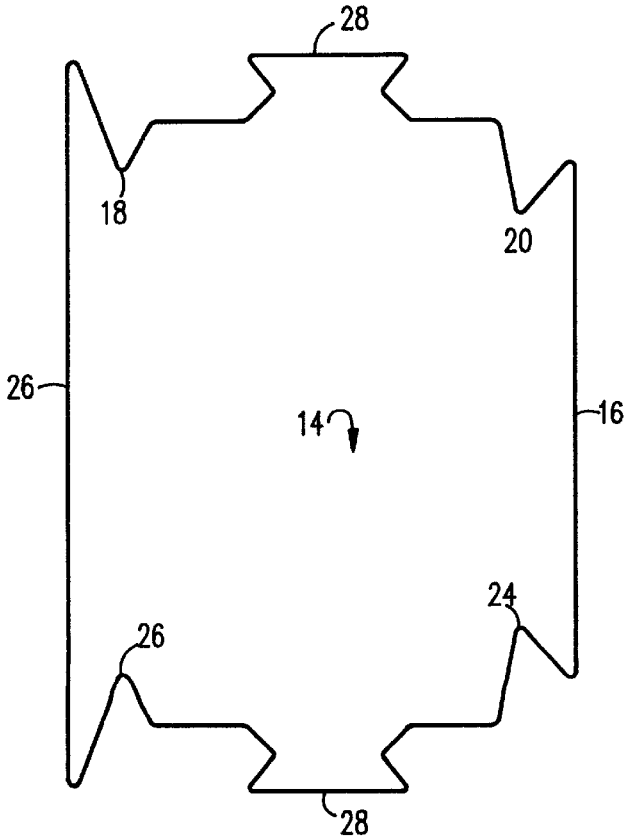
FIG. 2 is a front view of a frame of the invention.

Turning now to the drawings, in which similar referenced characters denote similar elements throughout the views, the figures illustrate an exemplary stack and sack holder for holding plastic bags with handles for recycling waste material. As will become apparent thorough the description of the invention, the present stack and sack holder is very versatile in its application and adaptable in its design.

As shown in FIGS. 1 through 6, the basic holder 10 is comprised of one manufactured part, a frame 12, which serves as the basic component of the holder 10. The frame 12 can be constructed of any suitable material that provide sufficient strength and flexibility. For instance, the frame 12 could be made of a sturdy plastic, wire material, fiberglass or metal. Additionally, the frame 12 could be constructed by combining any of the several materials, such as using recycled plastic reinforced with wire.

It can be seen that the selection of materials to make the frame 12 is virtually unlimited. The choice of the material from which the frame 12 is constructed can thus, be chosen by either the manufacturer, depending upon the particular application for the holder 10, or to the consumer, depending upon their tastes, needs and desires. The unlimited number of material from which the frame 12 can be constructed also allows the holder 10 to be made in an inexpensive and efficient manner so that the holder 10 can be sold to consumers at an affordable price.

As an example of the versatility of the holder 10, if consumers wanted the holder 10 to be brightly colored, the frames could be fabricated from plastic and dyed in a variety of colors. On the other hand, if the holder 10 was needed to be extra large and support the holding of heavy refuse, such as large glass containers or a great number of paper products, such as phone books, the frame 12 could be fabricated from metal or plastic reinforced with wire.

Although the frame 12 can be made from a variety of materials, in the preferred embodiment, the frame 12 is made from recycled plastic through the process of injection molding, thereby giving the holder 10 its desired sturdiness while providing an economic and environmental use for plastics. Also in the preferred embodiment, configuration of the plastic making up the frame 12 is generally tubular in shape, although any appropriate formation could be used. Finally, preferably, the frame 12 is offered in an assortment of colors so that the purchaser can pick an appropriate color for the room in which the holder 10 will be used.

The frame 12 can also be manufactured in a variety of ways. The possible methods of producing the frame 12 include it being cast, blown or molded into the desired final shape. The frame 12 could also be formed from a continuous length and then cut and formed or bent into the final shape.

The dimensions of the frame 12 and thus, the holder 10 can also vary, depending upon the desires of the consumer and the particular application for the holder 10. Therefore, the frame 12 can be of any appropriate height and width. In the preferred embodiment, each frame 12 is approximately 22 inches high and 18 inches wide. Also in the preferred embodiment, the frame 12 is formed into a rigid structure manufactured from recycled plastic.

However, the size of the frame 12 can be of any desired dimensions. A collection of holders 10 of different sizes could be produced so that they could be used in relatively small, medium or large areas. This is particularly useful as the stack and sack holder 10 can be used in apartments, which may only have small spaces available in the kitchen or other area for a recycling container, as well as offices, which may have large spaces available for recycling and the need to sort a large volume of refuse.

Although the shape of the frame 12 could also be varied if desired, in the preferred embodiment, the frame 12 is generally rectangular in shape with a large aperture 14 defined by the edges of the frame 12. Also in the preferred embodiment, the frame 12 is generally symmetrical about its horizontal axis. Thus, the frame 12 and holder 10 do not require a lot of material to be manufactured. This results in a further reduction of the cost to produce the holder. The clever shape of the frame 12 results in efficiency savings in manufacturing, shipping, storage and assembly of the holder 10.

The holder 10 consists of four identically formed frames 12 interlocked at complimentary lead-in notches. The frames 12 are assembled together to create the holder 10 without the need for nails, pegs, screws, tape or any other type of attachment means.

The frames 12 are also substantially identical. Thus, the assembly of the holder 10 can be easily accomplished by the consumer without the need for tools or complicated instructions. The holder 10 can also be assembled relatively quickly. Additionally, the holder 10 can also be easily disassembled by the consumer so that the holder 10 can be transported to a new location within the existing home or office, or to an entirely new home or office.

As can be seen in FIG. 1, the frames 12 are interlocked into each other to form the holder 10. In the description of the present invention, the terms "upper", "top", "lower", "bottom", "left", "right" and similar words are used to delineate the embodiments of the stack and sack holder. As mentioned previously, however, the frames 12 that comprise the stack and sack holder are generally symmetrical about their horizontal axis. Thus, the frames 12 could be inverted and still produce the holder 10. It is to be understood then that the terms stated above are all relative directional terms used in relation to the accompanying figures. These terms are for reference purposes only and should not be construed to limit the embodiments of the stack and sack holder of the invention.

Figure 4:
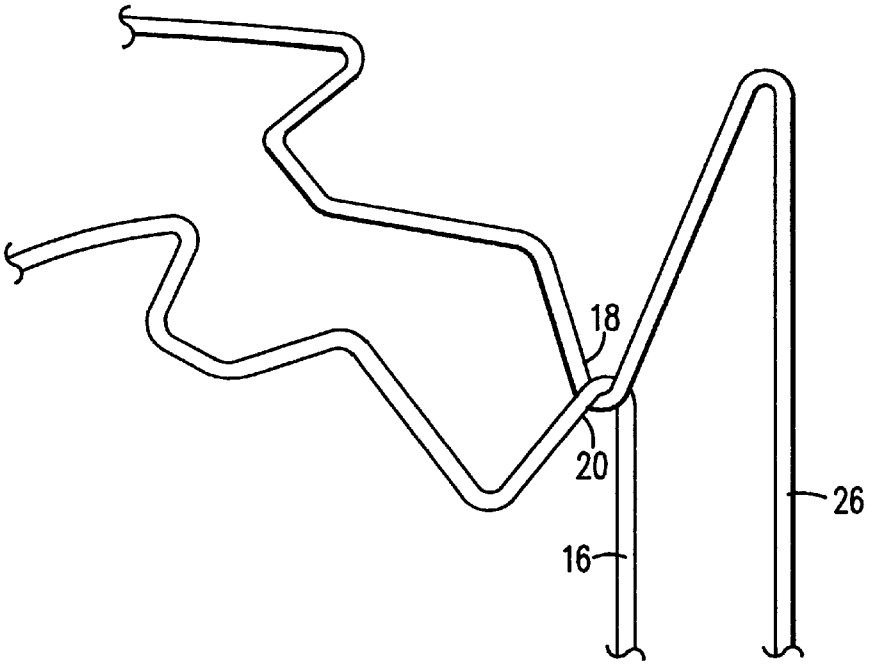
FIG. 4 is a close up view of the invention showing the upper inter-connecting notches.

As depicted in FIG. 4, the frames 12 are interlocked when one frame 12 is put through the receiving aperture 16 of a second frame 12 to interlock at the upper right concave lead-in notch or locking notch 18 of one frame 12 and the upper left convex lead-in notch or receiving notch 20 of another frame 12 and when the lower right convex lead-in notch or locking notch 22 of the first frame 12 is interlocked with the lower left concave lead-in notch or receiving notch 24 of the second frame 12.

The receiving aperture 16 of each frame 12 is typically pre-formed or formed into the frame 12 by suitable methods, such as bending one side of the frame 12 in the appropriate fashion. In the preferred embodiment, the receiving aperture 16 is bordered by the upper receiving notch 20 at one end and the lower receiving notch 24 at the other end.

The upper receiving notch 20 and lower receiving notch 24 can be shaped into appropriate fashion that results in the locking of the frames 12 together. In the preferred embodiment, the upper receiving notch 20 is generally convex with the distal portion of the receiving notch 20 having a vertical dimension which is greater than the vertical dimension of the inward portion of the receiving notch 24. This structure forms the receiving aperture 16 of the frame 12 for receiving the locking aperture 26 of another frame 12.

In the preferred embodiment, the vertical dimension of the receiving aperture 16 is equal to approximately 65% of the overall vertical dimension of the frame 12. Although the overall size of the receiving aperture 16 can vary, the formation of the receiving aperture 16 whose vertical dimension is greater than at least 40% of the total vertical dimension of the frame 12 will result in the holder 10 having a greater structural stability when connected to another frame 12 in the holder 10.

The locking aperture 26 of each frame 12 is similarly formed by bending the side of the frame 12 opposite the receiving aperture 16 in the appropriate fashion. In the preferred embodiment, the locking aperture 26 is bordered by the upper locking notch 18 at one end and the lower locking notch 22 at the other end.

The upper locking notch 18 and lower locking notch 22 can be shaped into any appropriate fashion that results in the locking of frames 12 together. In the preferred embodiment, the upper locking notch 18 is generally concave with the distal portion of the locking notch 18 having a vertical dimension which is greater than the vertical dimension of the inward portion of the locking notch 22. This structure forms the locking aperture 26 of the frame 12 for locking the locking aperture 26 into the receiving aperture 16 of another frame 12. In the preferred embodiment, the vertical dimension of the locking aperture 26 is relatively equal to the vertical dimension of the receiving aperture 16.

Figure 5:
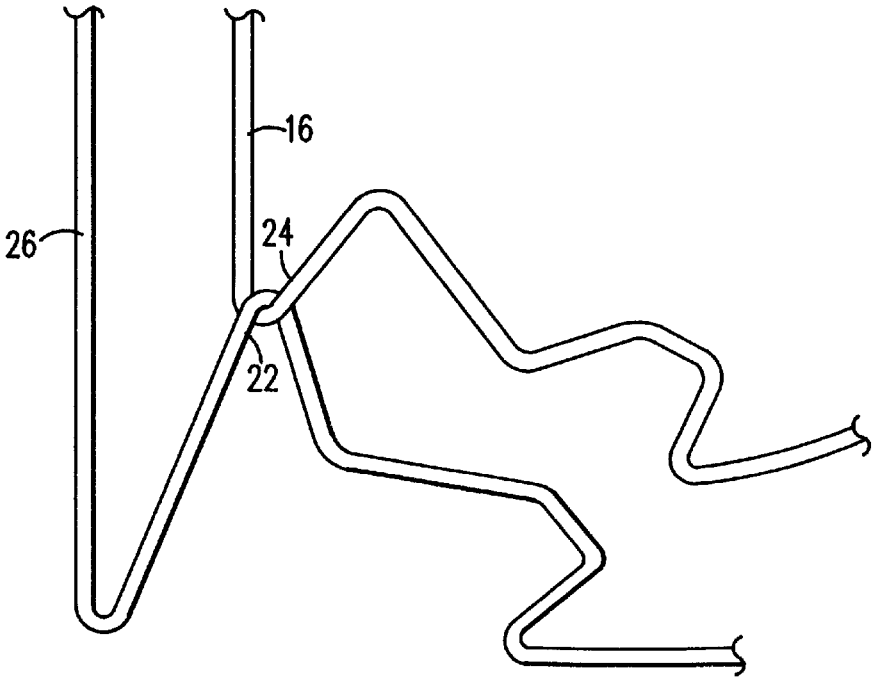
FIG. 5 is a close up view of the invention showing the lower inter-connecting notches.

The holder 10 is formed by securing a plurality of frames 12 together. In the preferred embodiment, the holder 10 is comprised of four identical interlocked frames 12. This structure is shown in FIG. 1. The assembly of the holder 10 is begun by inserting the locking aperture 26 of the first frame 12 into the receiving aperture 16 of the second frame 12 so that the locking aperture 26 is restricted from separating from the receiving aperture 16 of the second frame 12. As can be seen in FIGS. 4 and 5, this is accomplished by interlocking the upper locking notch 18 of the first frame 12 with the upper receiving notch 20 of the second frame 12 and interlocking the lower locking notch 22 of the first frame 12 with the lower receiving notch 24 of the second frame 12. In the preferred embodiment, the frames 12 of the holder 10 are sufficiently flexible to allow for the insertion of the frames 12 as described. The completion of the above steps results in a holder 10 with two interlocked frames 12. In the preferred embodiment, the two frames 12 are interlocked in a generally perpendicular fashion.

The construction of the holder 10 is then continued by inserting the locking aperture 26 of the second frame 12 into the receiving aperture 16 of a third frame 12. Once again, this is accomplished by interlocking the upper locking notch 18 of the second frame 12 with the upper receiving notch 20 of the third frame 12 and interlocking the lower locking notch 22 of the second frame 12 with the lower receiving notch 24 of the third frame 12. In the preferred embodiment, the second and third frames 12 are interlocked in a generally perpendicular fashion while the first and third frames 12 are in a generally parallel relationship to each other.

The construction of the holder 10 is then completed by inserting the locking aperture 26 of third frame 12 into the receiving aperture 16 of a fourth frame 12. This is again accomplished by interlocking the upper locking notch 18 of the third frame 12 with the upper receiving notch 20 of the fourth frame 12 and interlocking the lower locking notch 22 of the third frame 12 with the lower receiving notch 24 of the fourth frame 12.

Finally, the first and fourth frames 12 are secured together by interlocking the upper locking notch 18 of the fourth frame 12 with the upper receiving notch 20 of the first frame 12 and interlocking the lower locking notch 22 of the fourth frame 12 with the lower receiving notch 24 of the first frame 12. In the preferred embodiment, the completed holder 10 is generally square in shape with four equally sized sides formed by the frames 12 and equal angles between the frames 12. The holder 10 is also symmetrical about its longitudinal and latitudinal axes. Additionally, as each frame 12 is identical, the order by which the frames 12 are interlocked to form the holder 10 can vary. In an alternate embodiment, several holders 10 can be secured together in a horizontal fashion so that multiple holders 10 are positioned adjacent to each other.

The holder 10 is constructed so that it can hold vessels for sorting refuse, such as recycling items. This can be accomplished in numerous ways, including support shelves, pegs, attachments or other suitable structures. In the preferred embodiment, however, the holder 10 includes handles 28 on each frame 12. Although the handles 28 could be located at any suitable place on the frame 12, in the preferred embodiment, each frame 12 has two handles 28 positioned on the top and bottom of the frame 12. These handles 28 are located on the top of the frame 12 adjacent to the receiving aperture 16 and locking aperture 26. This permits the handles 28 to hold containers within the holder 10 when the frames 12 are interlocked.

As the frames 12 are symmetrical, they can be interlocked to form the holder 10 with the receiving aperture 16 and locking aperture 26 being interchangable on the longitudinal axis of the frame 12. This increases the versatility of the frames 12 and makes it easier for consumers to assemble the holder 10. Placing a handle 28 on opposite sides of the frame 12 ensures that a handle 28 is properly located on the top of the holder 10 no matter which way the frames 12 are orientated when they are assembled.

Having two opposite handles 28 on the frames 12 also has further advantages. While the top handle 28 provides a place for bags to be attached to the holder 10, the bottom handle 28 provides additional stability to the base of the holder 10 when it is assembled, as does each leg, or bottom portion, of the locking aperture 26. Thus, while having two handles 28 on each frame 12 is the preferred embodiment, if desired, the frames 12 could be manufactured so that they have only one handle 28. Similarly, the frames 12 could be manufactured so that they have multiple handles 28.

The specific shape and dimensions of the handles 28 can vary depending upon the needs of the consumer. However, the handles 28 should be sized so that they can receive and hold bags. In one embodiment of the invention, the horizontal dimension of the handle 28 is approximately 30% of the horizontal dimension of the entire frame 12 while the vertical dimension of the handle 28 is approximately 10% of the total vertical dimension of the frame 12. Also, in the preferred embodiment, the top ends of the handle 28 extend outwardly to a greater degree than the bottom ends of the handle 28. This configuration ensures that the handle 28 will properly secure a bag or other container attached to it.

It can be seen that the shape of the receiving aperture 16, locking aperture 26 and handles 28 on the frame 12 result in the frame 12 having an efficient profile. This results in lower manufacturing costs for the holder 10 and the minimizing of any wasted materials for constructing the frame 12 and holder 10.

A variety of containers could be used with the holder 10. In the preferred embodiment, plastic or paper trash bags with handles are looped over the handles 28 of the holder 10. As previously discussed, these plastic or paper bags with handles are usually obtained from a merchant and are used to transport the customers' purchases from the store to the purchasers' car and home. After removing the purchases from these bags, however, the bags create a waste disposal problem. Whereas before, the bags would be thrown out, under the teachings of this application, these paper and plastic bags can be placed temporarily in the holder by looping the handles around the handles 28 of the holder 10.

Figure 7:
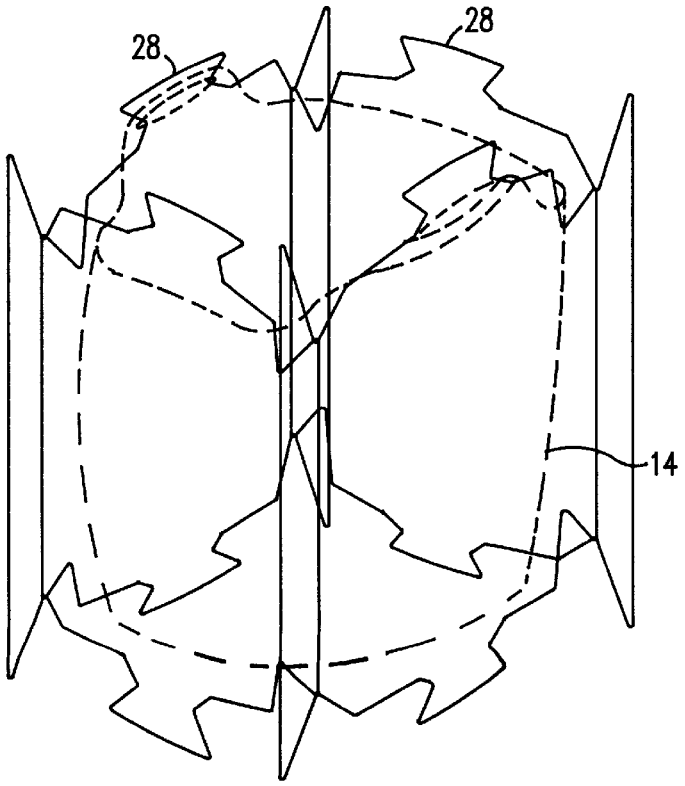
FIG. 7 is a perspective view of the invention showing a plastic bag looped over the handles of a holder.
Figure 8:
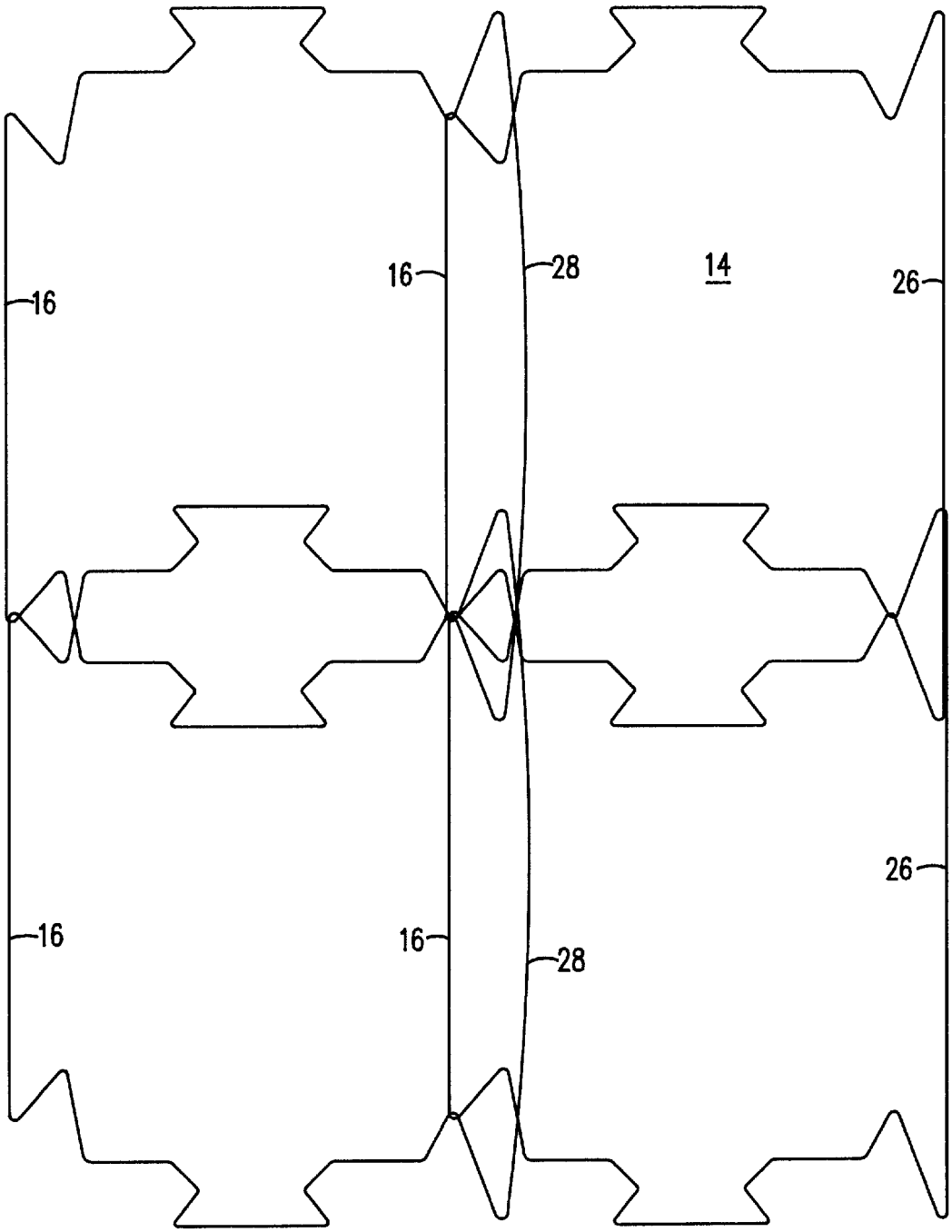
FIG. 8 is a front view of the invention showing four holders in a stacked formation.
Figure 9:
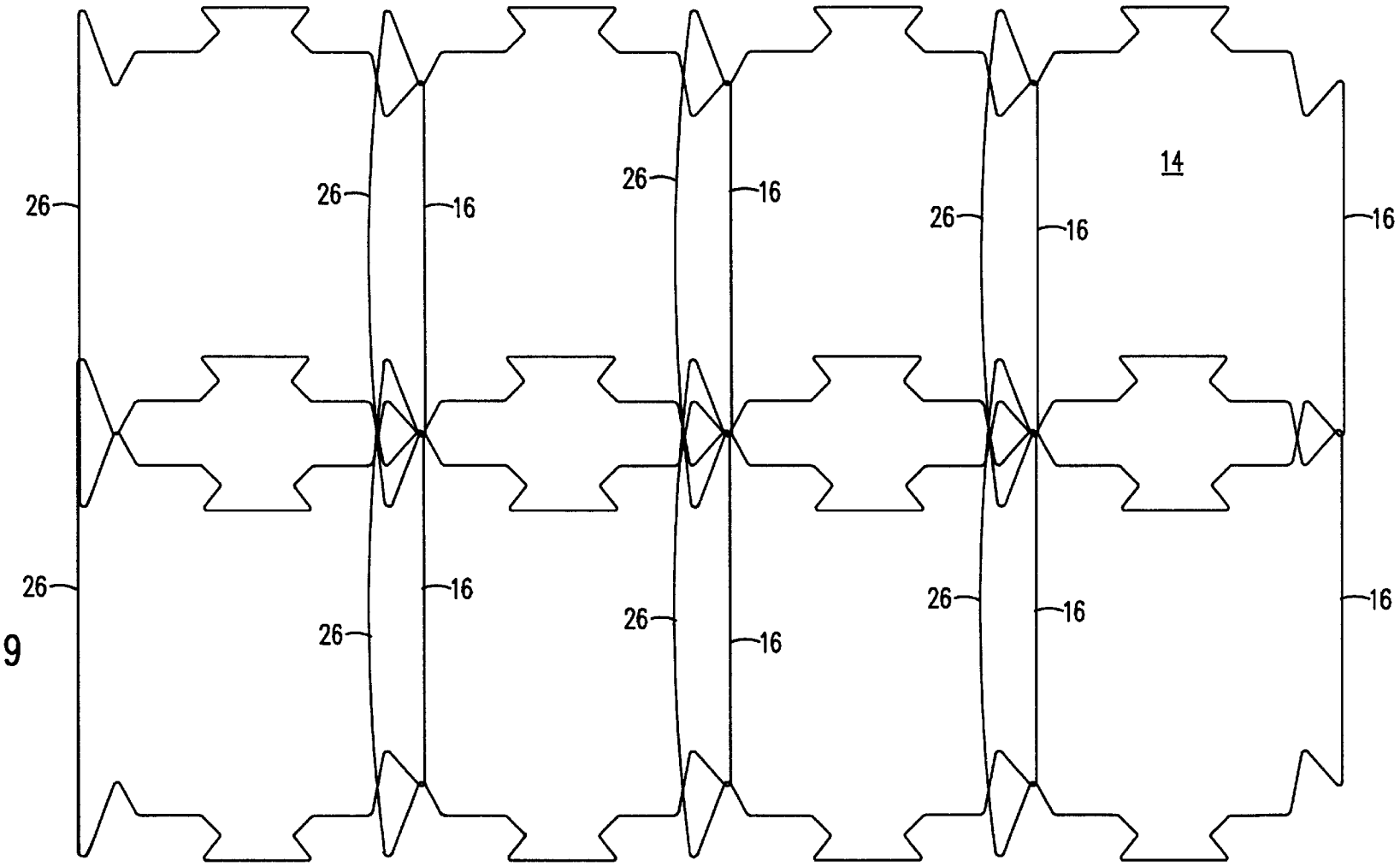
FIG. 9 is a front view of the invention showing eight holders in a stacked formation.

The paper and plastic bags with handles that are supplied by merchants are generally substantially uniform in size. Thus, the handles 28 of the holder 10 can be sized so that the handles of the bags easily, yet snugly, fit over the handles 28 of the holder 10. Additionally, the bags can either be looped over the handles 28 of the holder 10 individually or they can be nested within one another. As shown in FIG. 7, when the handles of the bags are positioned over the handles 28 of the holder 10, the bags are then suspended within the holder 10 in an open position and are ready to receive refuse or other materials.

A particularly unique feature of the stack and sack holder 10 is that it is configured so that multiple holders 10 can be stacked on top of one another. This feature is particularly useful when storage space for the holder 10 is limited but separate holders 10 are desired to sort a variety of different recyclable refuse. Even when multiple holders 10 are stacked together, the large apertures 14 of the frames 12 still remain open and intact. This permits easy access to all of the bags suspended within the holders 10 so that the bags can be removed from the holders 10 when the consumer desires to transport the bags to the appropriate location. Such locations include, for instants, a recycling facility or the curbside of the consumer's residence for pick up by the city. In one embodiment, two holders 10 are stacked together and plastic bags are placed over the handles 28 of the holders 10. The holders 10 are then used to hold and sort different recycling refuse, such as glass or plastic materials and bottles, aluminum cans and newspaper.

Figure 3:
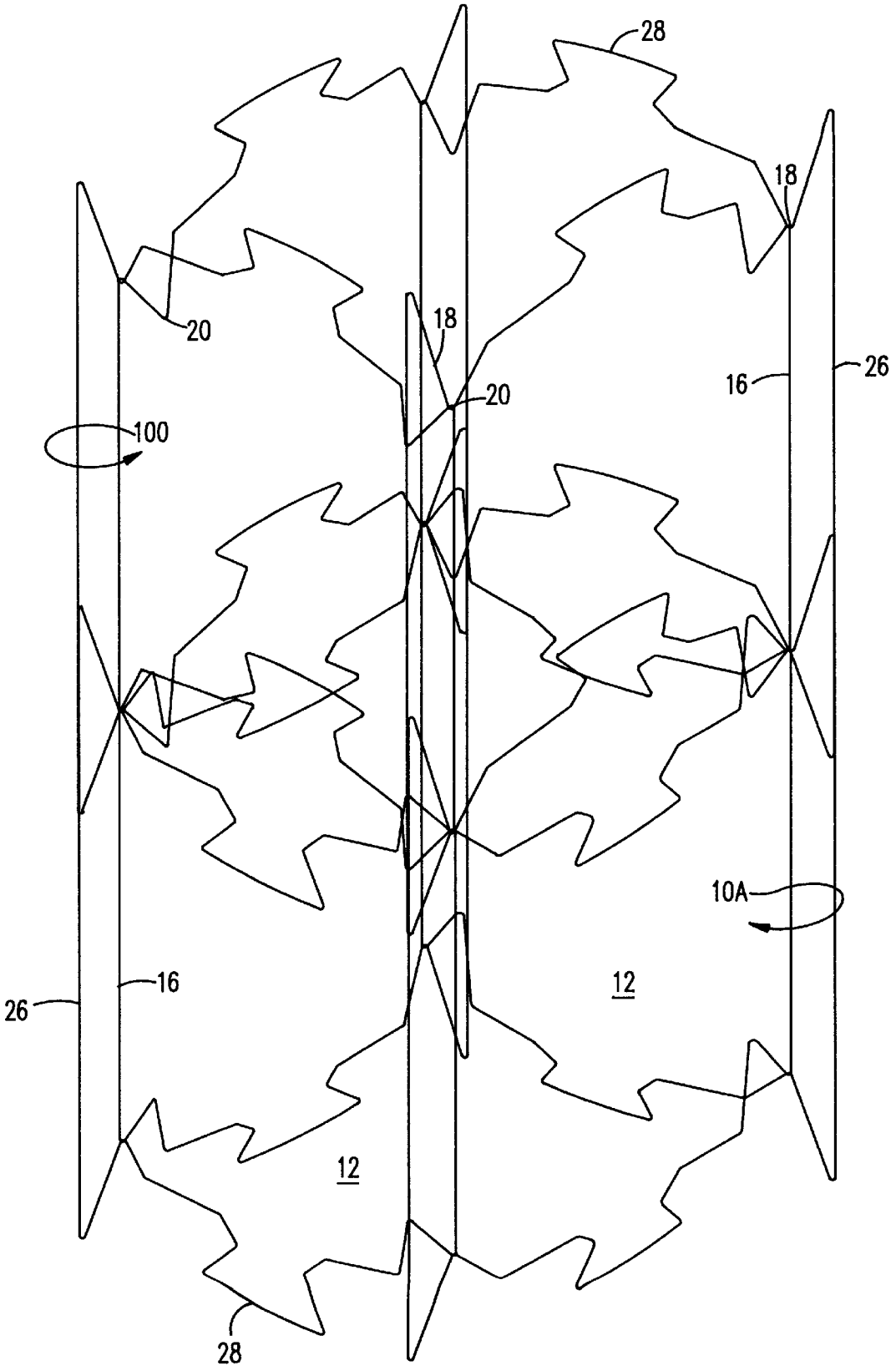
FIG. 3 is a perspective view of the invention in a stacked formation.

FIG. 3 depicts multiple holders 10A and 10B stacked together. The stacking of one holder 10B above another holder 10A can be accomplished by placing the top holder 10B inside the top of the bottom holder 10A at matching complementary lead-in notches. The top holder 10B is positioned inside the bottom holder 10A so that the bottom holder 10A is bracing the top holder 10B.

Thus, the lower receiving notches 24 and the lower locking notches 22 of each frame 12 making up the top holder 10B are positioned so that they are bordering the upper receiving notches 20 and upper locking notches 18 of each frame 12 making up the bottom holder 10A. The top holder 10B and bottom holder 10A are then interlocked so that they remain relatively rigid and so that the bottom holder 10A is able to support the top holder 10B.

Stacked holders 10A and 10B are depicted in FIG. 3. As can be seen from this Figure, each holder 10A and 10B is constructed as an individual unit, as described previously, and is capable of functioning as an independent holder for sorting recycling refuse. Thus, the locking apertures 26 of the bottom holder 10A are inserted into the receiving apertures 16 of the bottom holder 10A, as previously described. Similarly, the locking apertures 26 of the top holder 10B are inserted into the receiving apertures 16 of the top holder 10B. The top holder 10B can then be placed on top of the bottom holder 10A.

Figure 6:
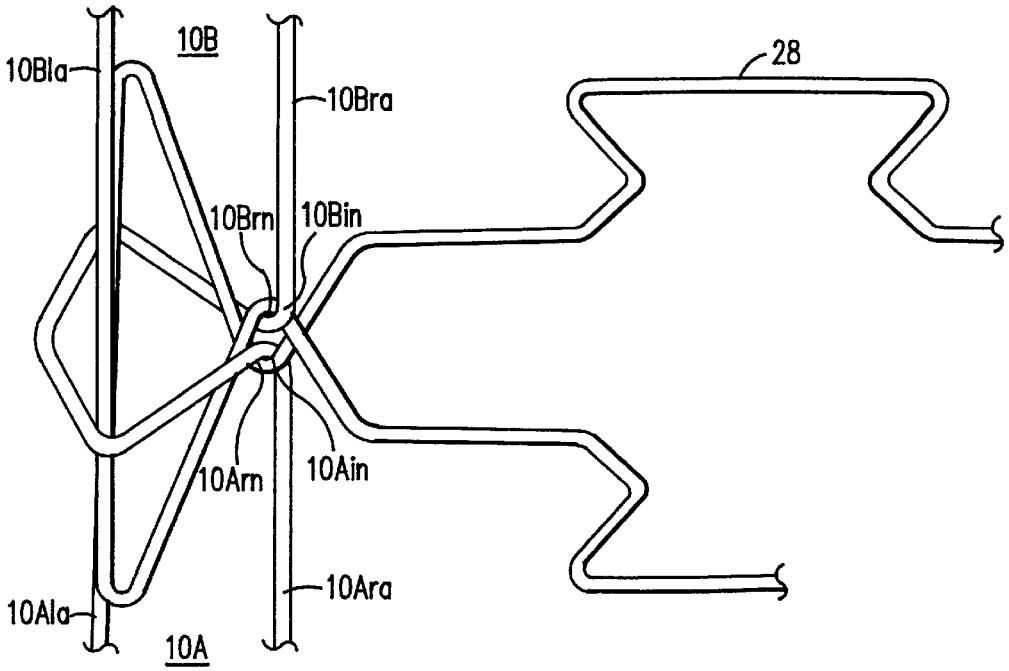
FIG. 6 is a close up view of the invention showing the inter-connection of two nested holders.

FIG. 6 shows a close up of the intersection of the two stacked holders 10A and 10B. As shown in this Figure, the locking aperture $\mathbf{10}A_{la}$ of the bottom holder 10A is inserted into the receiving aperture $\mathbf{10}A_{ra}$ of the bottom holder 10A so that the upper locking notch $\mathbf{10}A_{ln}$ of the bottom holder 10A is interlocked with the upper receiving notch $\mathbf{10}A_{rn}$ of the bottom holder 10A. In a similar fashion, the locking aperture $\mathbf{10}B_{la}$ of the top holder 10B is inserted into the receiving aperture $\mathbf{10}B_{ra}$ of the top holder 10B so that the lower locking notch $\mathbf{10}B_{ln}$ of the top holder 10B is interlocked with the lower receiving notch $\mathbf{10}B_{rn}$ of the bottom holder 10B.

In order to stack the two holders 10A and 10B, the top holder 10B is placed on top of the bottom holder 10A so that the lower locking notch $\mathbf{10}B_{ln}$ and lower receiving notch $\mathbf{10}B_{rn}$ of the top holder 10B is nested into the upper locking notch $\mathbf{10}A_{ln}$ and upper receiving notch $\mathbf{10}A_{rn}$ of the bottom holder 10A. The lower portion of the locking aperture 26 of the top holder 10B is also positioned so that it overlaps and is adjacent to the upper portion of the locking aperture 26 of the bottom holder 10A. The lower portion of the receiving aperture 16 of the top holder 10B and the upper portion of the receiving aperture 16 of the bottom holder 10A are positioned in a similar fashion. Thus, in the preferred embodiment, for stacked holders 10A and 10B, all four of the lower locking notches $\mathbf{10}B_{ln}$ and lower receiving notches $\mathbf{10}B_{rn}$ of the top holder 10B are nested into all four of the upper locking notches $\mathbf{10}A_{ln}$ and upper receiving notches $\mathbf{10}A_{rn}$ of the bottom holder 10A.

In this way, two or more holders 10 can be stacked together to form a larger holder 10 that is capable of holding and sorting different types of recycling refuse. The number of holders 10 stacked together depends only upon the desires of the consumer and the storage space allowed for the holders 10 in the home, office or apartment.

When multiple holders 10 are stacked together, the large aperture of each frame 12 of the holders 12 remains open so that the inside of the holders 10 remains accessible to the consumer. As previously discussed, the frames 12 are constructed with narrow side borders so that the completed frames 12 have a slender and efficient profile. After the stacked holders 10A and 10B are interlocked, the borders of the frames 12 are united together.

Thus, the large apertures 14 remain on all sides of the upper holder 10B and lower holder 10A. Unlike traditional trash containers, these large apertures 14 allow the consumer to place the bags over the handles 28 of the holders 10, sort recyclable refuse in the holders 10 and access and remove the bags from the handles 28 of the holders 10 to facilitate their transportation to the recycling facility, from any side of the holders 10, whether it be the front, back or sides of the holders 10, even when the holders 10 are stacked one on top of another.

In use, the stack and sack holder 10 has a variety of applications. It could be constructed of any appropriate materials, and used to hold, sort and dispose of an assortment of materials. The following description, however, refers to the preferred embodiment of the invention.

In the preferred embodiment, the frames 12 of the stack and sack holder are manufactured in the appropriate manner, such as molding, forming, pressing or injecting them. The actual manufacturing process can be chosen based upon such factors as cost, efficiency and available equipment.

The frames 12 are constructed of recycled plastic. This makes the frame 12 environmentally friendly as no materials are wasted to construct the frame 12 and the building of the holder provides a market for recycled plastic, which otherwise would potentially go to a landfill. If desired, the plastic could be reinforced with wire with a diameter of approximately 3/16 of an inch. Finally, the frames 12 are dyed in a variety of colors so that the consumer has a wide choice of holders 10 to match the interior of the home, office or apartment.

The frames 12 are formed so that they have a receiving aperture 16, a locking aperture 26, an upper concave lead-in or locking notch 18, an upper convex lead-in or receiving notch 20, a lower convex lead-in or locking notch 22 and a lower concave lead-in or receiving notch 24. The frames also have two opposing handles 28. These items define a large aperture 14 in each frame 12.

The holders 10 can be sold as pre-assembled units or as individual frames 12 that can be assembled by the consumer. After the consumer buys the frames 12, he or she takes them home and assembles them into the holder 10. As the frames 12 are identical to each other and symmetrical about their horizontal axes, the assembly of the frames 12 into a holder 10 is a relatively straight forward process. The frames 12 are assembled into a holder 10 by interlocking the locking aperture 26 of the first frame 12 to the receiving aperture 16 of the second frame 12, the locking aperture 26 of the second frame 12 to the receiving aperture 16 of the third frame 12, the locking aperture 26 of the third frame 12 to the receiving aperture 16 of the fourth frame 12 and the locking aperture 26 of the fourth frame 12 to the receiving aperture 16 of the first frame 12.

After the holder 10 is assembled, the consumer loops the handles of a plastic bags with handles over opposing handles 28 of two of the frames 12. The handles 28 suspend the bag within the holder 10 in an open position. The larger apertures 14 defined by each of the frames 12 allow the bag to be accessed by the consumer from the front, back or sides of the holder 10.

When the consumer desires to have multiple stacked holders 10, he or she can purchase additional frames 12 and construct new holders 10. The holders can then be stacked one on top of another to provide for a holder 10 for holding multiple containers. To accomplish the stacking of the holders, one holder 10B is placed on top of another holder 10A so that the lower locking notches $\mathbf{10}B_{ln}$ and lower receiving notches $\mathbf{10}B_{rn}$ of the top holder 10B are nested into the upper locking notches $\mathbf{10}A_{ln}$ and upper receiving notches $\mathbf{10}A_{rn}$ of the bottom holder 10A, thereby securing the holders 10A and 10B together.

The consumer then loops the handles of plastic bags over the handles 28 of each holder 10 so that the bags are ready to receive refuse. The large apertures 14 of the frames 12 are still present when the holders 10 are in the stacked formation. Thus, the bags in each holder 10 can be accessed from the front, back or sides of the holders 10.

Each holder 10 is capable of holding and sorting refuse. Thus, if the consumer has two holders 10 stacked together, they could sort, for example, plastic bottles in one holder 10 and aluminum cans in the other. When the consumer has an empty glass bottle, for example, it can be easily placed in one of the holders 10. Empty aluminum cans can also be placed in the other holder 10. In this way, the recycling refuse is held and sorted for the consumer in a convenient manner.

When a bag within a holder 10 becomes full, or when the consumer desires to take the refuse to a recycling facility, the consumer can easily reach the plastic bags through any of the large apertures 14 on the front, back or sides of the holders 10. The consumer merely reaches into the holder 10, unloops the handles of the bag from the handles 28 on the holder 10, and removes the bag. The consumer can then place a new bag in the holder 10. The compact design of the frames 12 also allows the consumer to easily disassemble and store the holders 10.

The utilization of the invention stack and sack holder can also be carried out by different ways than presented here. While a preferred embodiment of the present invention has been described, it should be understood that various changes, adaptations and modifications may be made therein without departing from the spirit of the invention and the scope of the appended claims.

What is claimed is:

1. A a stackable refuse holder for constructing a stackable storage holder for holding, sorting and assisting in the disposal of refuse, comprising:

a plurality of frames, each frame comprising an upper boundary and a lower boundary;

a first locking notch positioned on the upper boundary of the frame, a first receiving notch positioned on the upper boundary of the frame opposite the first locking notch;

a first handle positioned on the upper boundary of the frame between the first locking notch and first receiving notch;

a second locking notch positioned on the lower boundary of the frame;

a second receiving notch positioned on the lower boundary of the frame opposite the second locking notch, and a second handle positioned on the lower boundary of the frame between the second locking notch and second receiving notch, said first and second locking notches defining a locking aperture and said first and second receiving notches defining a receiving aperture, wherein four substantially similar said frames adjoin and are interlocked to form a generally square holder, the holder being formed by interlocking locking apertures with receiving apertures of adjoining frames so that adjoining frames are generally perpendicular to each other.

2. The stackable refuse holder of claim 1 wherein the boundaries of the frame defines a space that is substantially open.

3. The stackable refuse holder of claim 2 including a container bag with a handle which is removably attached to one of said handles of one of said frames so that the bag is situated in an open position.

4. The stackable refuse holder of claim 3 wherein a plurality of frames are interconnected to form multiple holders and wherein the holders are stacked on top of each other in a vertical fashion.

* * * * *